US011746629B2

(12) United States Patent
Rabaa et al.

(10) Patent No.: US 11,746,629 B2
(45) Date of Patent: Sep. 5, 2023

(54) AUTONOMOUS SEPARATED GAS AND RECYCLED GAS LIFT SYSTEM

(71) Applicant: SAUDI ARABIAN OIL COMPANY, Dhahran (SA)

(72) Inventors: Ali Saleh Rabaa, Dhahran (SA); Raul Leal Martinez, Dhahran (SA); Abdullah M. Alhabah, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 21 days.

(21) Appl. No.: 17/246,420

(22) Filed: Apr. 30, 2021

(65) Prior Publication Data

US 2022/0349283 A1 Nov. 3, 2022

(51) Int. Cl.
*E21B 43/12* (2006.01)

(52) U.S. Cl.
CPC ..... *E21B 43/123* (2013.01)

(58) Field of Classification Search
CPC ..... E21B 43/123
See application file for complete search history.

(56) References Cited

U.S. PATENT DOCUMENTS

| | | | | |
|---|---|---|---|---|
| 5,794,697 | A | 8/1998 | Wolflick et al. | |
| 6,189,614 | B1 | 2/2001 | Brady et al. | |
| 7,686,075 | B2 | 3/2010 | Stewart et al. | |
| 9,719,311 | B2 | 8/2017 | Tunget | |
| 9,863,222 | B2 | 1/2018 | Morrow et al. | |
| 2003/0164240 | A1* | 9/2003 | Vinegar | E21B 47/13 137/155 |
| 2005/0135944 | A1 | 6/2005 | Matic | |
| 2009/0159334 | A1* | 6/2009 | Alberty | E21B 21/08 175/40 |
| 2012/0138308 | A1* | 6/2012 | Noui-Mehidi | E21B 43/12 166/187 |

(Continued)

FOREIGN PATENT DOCUMENTS

WO 2020049102 A1 3/2020

OTHER PUBLICATIONS

J.S. Weingarten et al., "Development and Testing of a Compact Liquid-Gas Auger Partial Separator for Downhole or Surface Applications", SPE-30637-PA, SPE Production & Facilities, Feb. 1997 (7 pages).

(Continued)

*Primary Examiner* — Abby J Flynn
*Assistant Examiner* — Yanick A Akaragwe
(74) *Attorney, Agent, or Firm* — Osha Bergman Watanabe & Burton LLP

(57) ABSTRACT

A gas lift system includes tubing configured to be a conduit for production fluids having a weight, an inflow control valve, installed within the tubing, configured to control gas from the gas reservoir into the well, a gas-separator compressor turbine device installed within the tubing, a gas lift valve configured to allow flow of the gas from the annulus into the tubing, and an injection pressure operated gas lift valve configured to allow flow of the gas from the annulus into the tubing. The gas and the production fluids, from the oil reservoir, mix to lower the weight of the production fluids and flow the production fluids through the tubing to be produced at a surface location.

15 Claims, 7 Drawing Sheets

(56) References Cited

U.S. PATENT DOCUMENTS

| | | | | |
|---|---|---|---|---|
| 2015/0233228 | A1* | 8/2015 | Roth | E21B 43/38 166/372 |
| 2019/0162330 | A1* | 5/2019 | Al-Ajmi | E21B 34/10 |
| 2019/0316451 | A1* | 10/2019 | Al-Gouhi | E21B 47/06 |

OTHER PUBLICATIONS

F.T. Al-Khelaiwi et al., "Advanced Wells: A Comprehensive Approach to the Selection Between Passive and Active Inflow-Control Completions", SPE-132976-PA, SPE Production & Operations, Aug. 2010 (22 pages).

Vasper, Adam, "Auto, Natural, or In-Situ Gas-Lift Systems Explained", SPE-104202-PA, SPE Productions & Operations, Feb. 2008 (6 pages).

* cited by examiner

AUTONOMOUS SEPARATED GAS AND RECYCLED GAS LIFT SYSTEM

BACKGROUND

Hydrocarbon fluids are often found in hydrocarbon reservoirs located in porous rock formations far below the earth's surface. Production wells may be drilled to extract the hydrocarbon fluids from the hydrocarbon reservoirs. Often, hydrocarbon fluids are able to flow naturally through production wells because the pressure within the reservoir is high enough to encourage the hydrocarbons to the surface. However, when a reservoir becomes depleted, or is naturally a reservoir with low-pressure, forms of "artificial lift" may be utilized to produce the hydrocarbon fluids. The two categories of artificial lift are pumping systems and gas lift.

Gas lift uses a source of high-pressure gas to lower the density of or "lift" the hydrocarbon fluids to the surface. Gas lift systems use an external source of gas which is injected into production tubing located in the production well. The gas mixes with the hydrocarbon fluids in the production tubing. This reduces the density of the hydrocarbon fluids until the mixture becomes light enough to flow using the available reservoir pressure. The external source of gas may be gas compressed at the surface or gas from a gas cap. Using gas compressed at the surface has compression limitations and is costly. Conventional gas lift methods using gas from the gas cap do not have the ability to re-circulate the gas, and the gas caps eventually become depleted.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure presents, in one or more embodiments, a gas lift system and method for producing a well, having an annulus, completed across a gas reservoir and an oil reservoir. The gas lift system includes tubing configured to be a conduit for production fluids having a weight, an inflow control valve, installed within the tubing, configured to control gas from the gas reservoir into the well, a gas-separator compressor turbine device installed within the tubing, a gas lift valve configured to allow flow of the gas from the annulus into the tubing, and an injection pressure operated gas lift valve configured to allow flow of the gas from the annulus into the tubing. The gas and the production fluids, from the oil reservoir, mix to lower the weight of the production fluids and flow the production fluids through the tubing to be produced at a surface location.

In further embodiments, the method for producing the well includes deploying a gas lift system into the well. The gas lift system includes tubing configured to be a conduit for production fluids having a weight, an inflow control valve, a gas-separator compressor turbine device, and a gas lift valve. The inflow control valve, the gas-separator compressor turbine device, and the gas lift valve are configured to be installed within the tubing. The method further includes opening the inflow control valve to allow gas to flow from the gas reservoir into the tubing, separating the gas from the production fluids using the gas-separator compressor turbine device, compressing the gas using the gas-separator compressor turbine device, injecting the gas into the annulus using the gas-separator compressor turbine device, flowing the gas through the gas lift valve into the tubing, mixing the gas and the production fluids to lower the weight of the production fluids, and flowing the production fluids through the tubing to be produced at a surface location.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
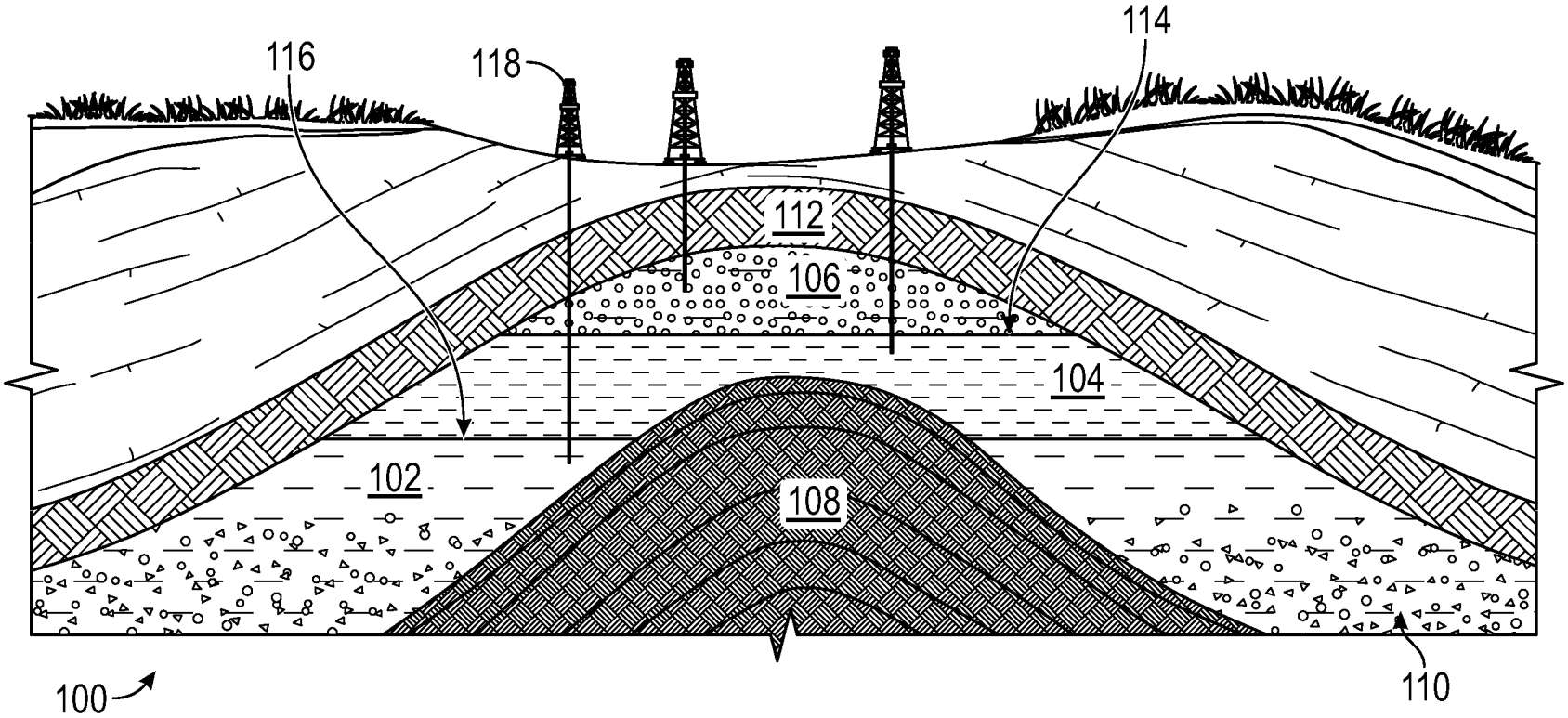
FIG. 1 shows an exceptional hydrocarbon reservoir in accordance with one or more embodiments.

FIG. 1 shows an exceptional reservoir (100) having water (102), oil (104), and gas (106). Conventional reservoirs (100), such as the one depicted in FIG. 1, have a source formation (108), a reservoir formation (110), and a cap rock (112). A source formation (108) is a formation rich in organic matter that, over time, is heated sufficiently to form hydrocarbon fluids such as gas (106) and oil (104). Oil (104) and gas (106) then migrate from the source formation (108) to a more porous and permeable rock called the reservoir formation (110). Due to the inherent nature of these subsurface fluids, gas (106) settles above oil (104) and oil (104) settles above water (102) in the reservoir (100). Therefore, there are various "contacts" within the reservoir (100) that distinguish locations of different subsurface fluids.

The gas oil contact (GOC) (114) is the location or "surface", in the reservoir (100), above which predominantly gas (106) occurs and below which predominately oil (104) occurs. The gas (106) that accumulates above the GOC (114) may be called a gas cap or a gas cap reservoir. The oil water contact (OWC) (116) is the location or "surface", in the reservoir (100), above which predominantly oil (104) occurs and below which predominately water (102) occurs. Wells (118) may be drilled into the reservoir (100) to gather data, produce hydrocarbon fluids, and/or treat the formation. Each well (118) may be an exploration well (118), a production well (118), or an injection well (118). Production and injection wells (118), drilled into similar reservoirs (100), typically target the oil (104) as the primary hydrocarbon fluid being produced and may inject water (102) to balance reservoir (100) pressure as reservoir (100) pressure declines as oil is produced. Injection wells (118) may also inject chemicals into the formation (110) to treat the formation (110) and help produce oil (104). The production wells (118) may produce water (102) and gas (106) as secondary fluids.

Figure 2:
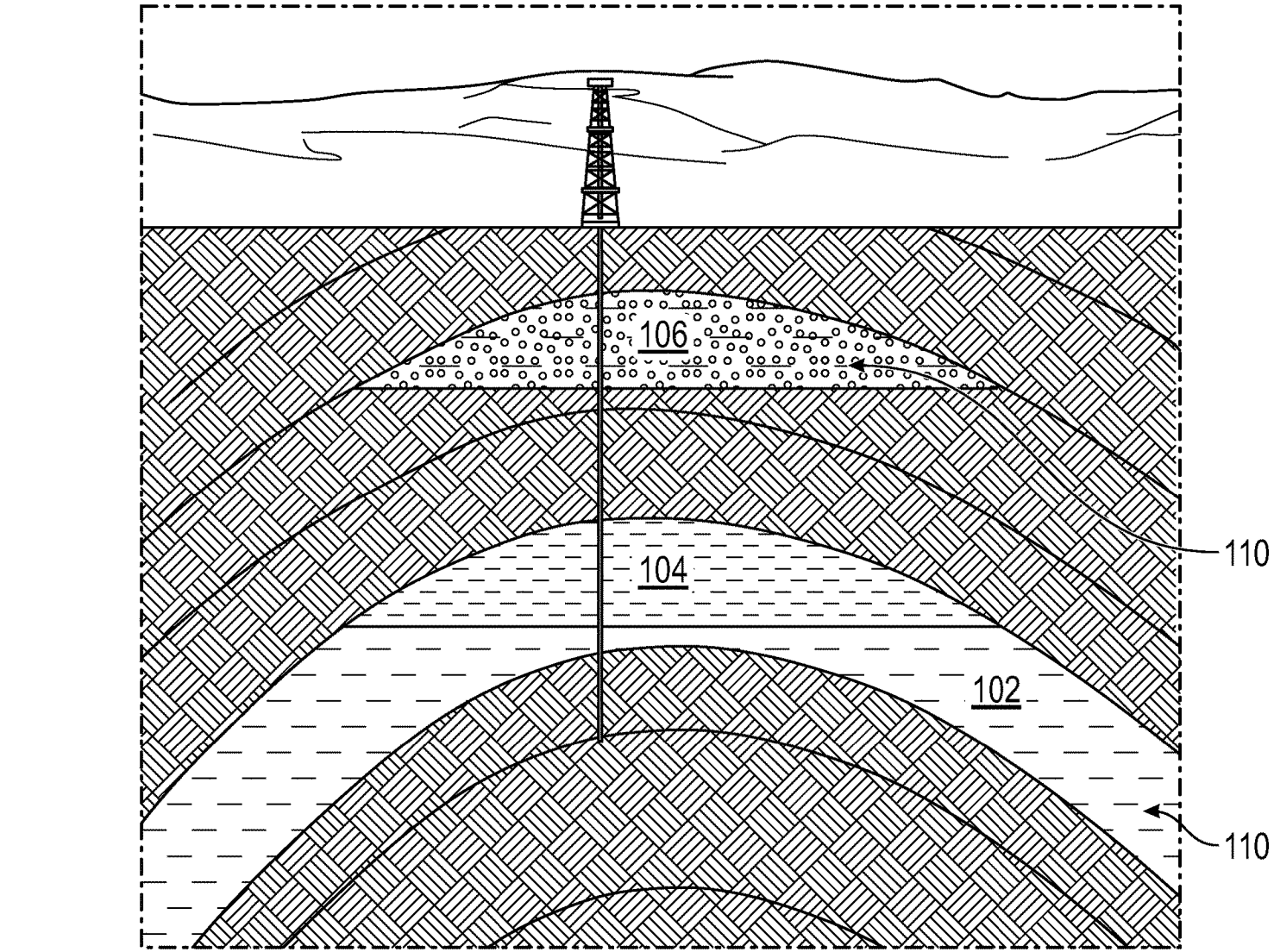
FIG. 2 shows an exceptional hydrocarbon reservoir in accordance with one or more embodiments.

FIG. 2 depicts another reservoir (100) which has water (102) and oil (104) located in the same reservoir formation (110) with gas (106) located in a different reservoir formation (110). The water (102) and oil (102) reservoir formation (110) is overlain by the gas (103) reservoir formation (110). The gas (106) that accumulates within the gas (106) reservoir formation (110) is called non-associated gas (106). The reservoirs (100) depicted in FIG. 1 and FIG. 2 may both be used without departing from the scope of the disclosure herein.

Figure 3:
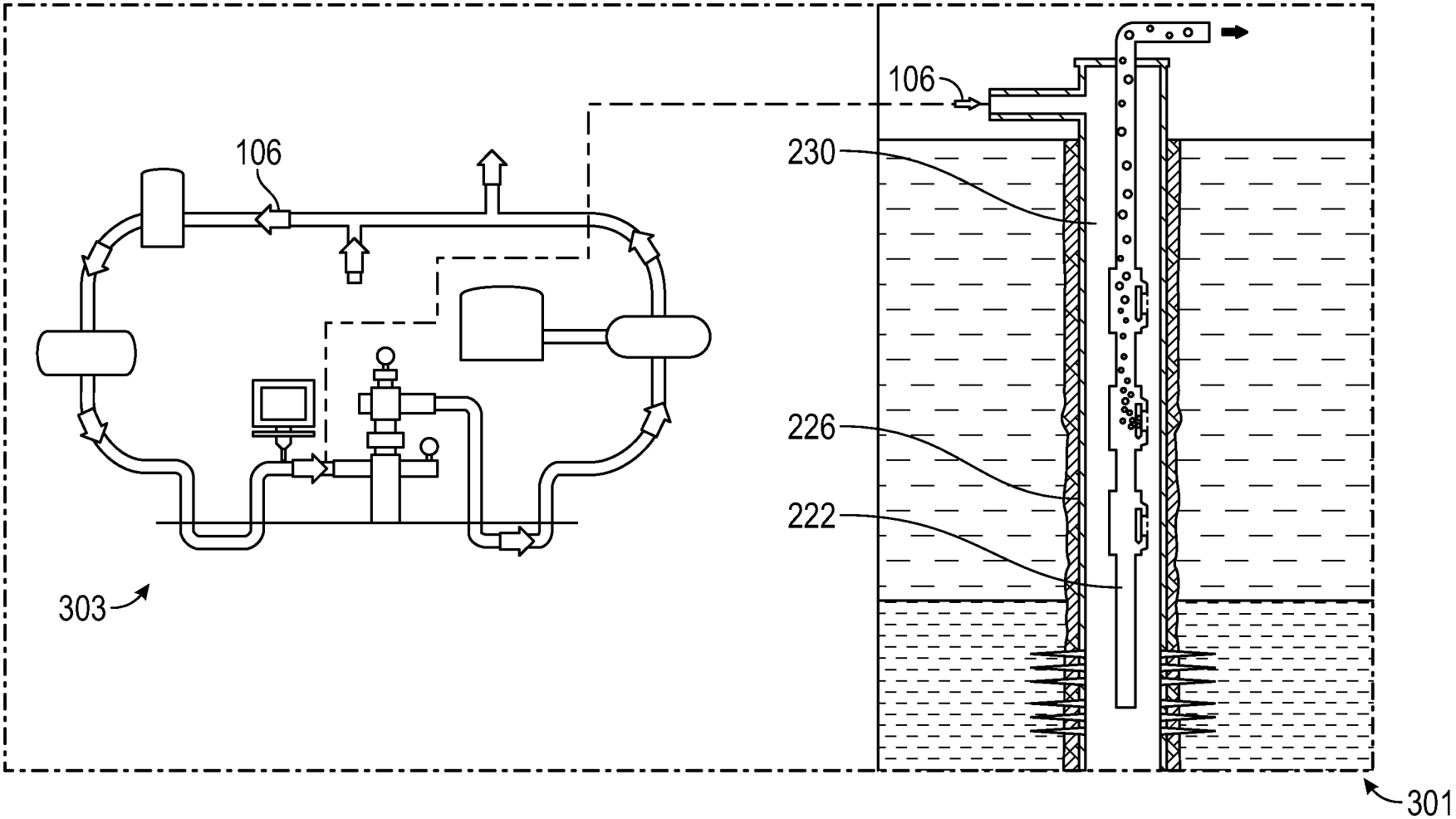
FIG. 3 shows a conventional gas lift system in accordance with one or more embodiments.

FIG. 3 depicts a conventional gas lift system (301). Conventional gas lift systems (301) use separated compressed gas (106) from a surface facility (303) and inject gas (106) from the surface facility (303) into the casing (226) annulus (230) at a high injection pressure. The gas (106) enters the production tubing string (222), at the high pressure, and mixes with the fluid (such as oil (106)) located within the production tubing string (222). Additionally, the industry may use natural, or auto, gas lift systems which use gas (106) from a gas cap, or another form of formation gas (106).

The conventional gas lift system (301) and the natural gas lift systems are designed to produce the gas (106) along with the desired hydrocarbon fluids (such as oil (104)). This means that the gas (106) cannot be re-circulated, and gas (106) is continually being drawn from the gas cap, or the non-associated gas (106) reservoir formation (110) as depicted in FIG. 2, into the well (118). This depletes the gas cap/non-associated gas (106) reservoir formation (110) over time and eventually there may not be enough gas (106) to use for lifting the downhole fluids, such as oil (104). Thus, it is beneficial to have a gas lift system that has the ability to re-circulate the gas (106) back into the system without having surface separation and re-injection equipment. Accordingly, embodiments disclosed herein present a system for gas lift, using in-situ gas (106) from a gas cap or other gas reservoir, where the gas (106) is able to be re-circulated into the system using downhole equipment.

Figure 4B:
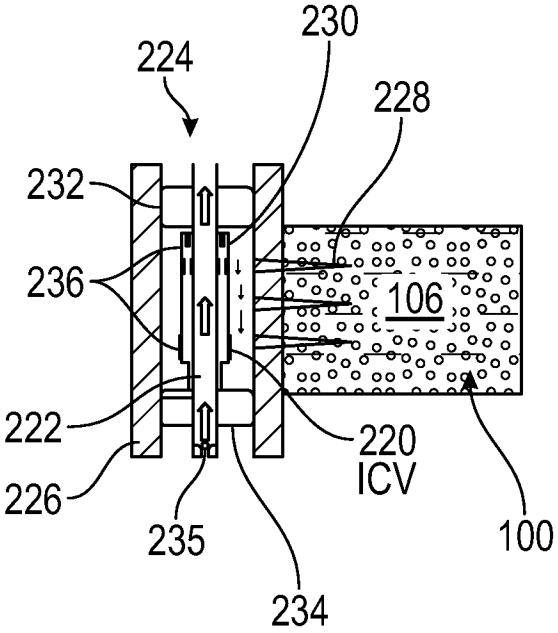
FIGS. 4*a*-4*b* show an inflow control valve in an open and in a closed position in accordance with one or more embodiments.
Figure 4A:
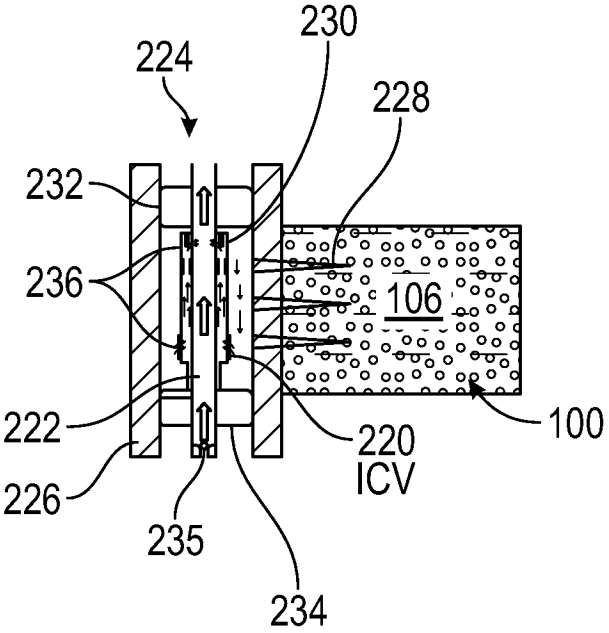
Figure 5:
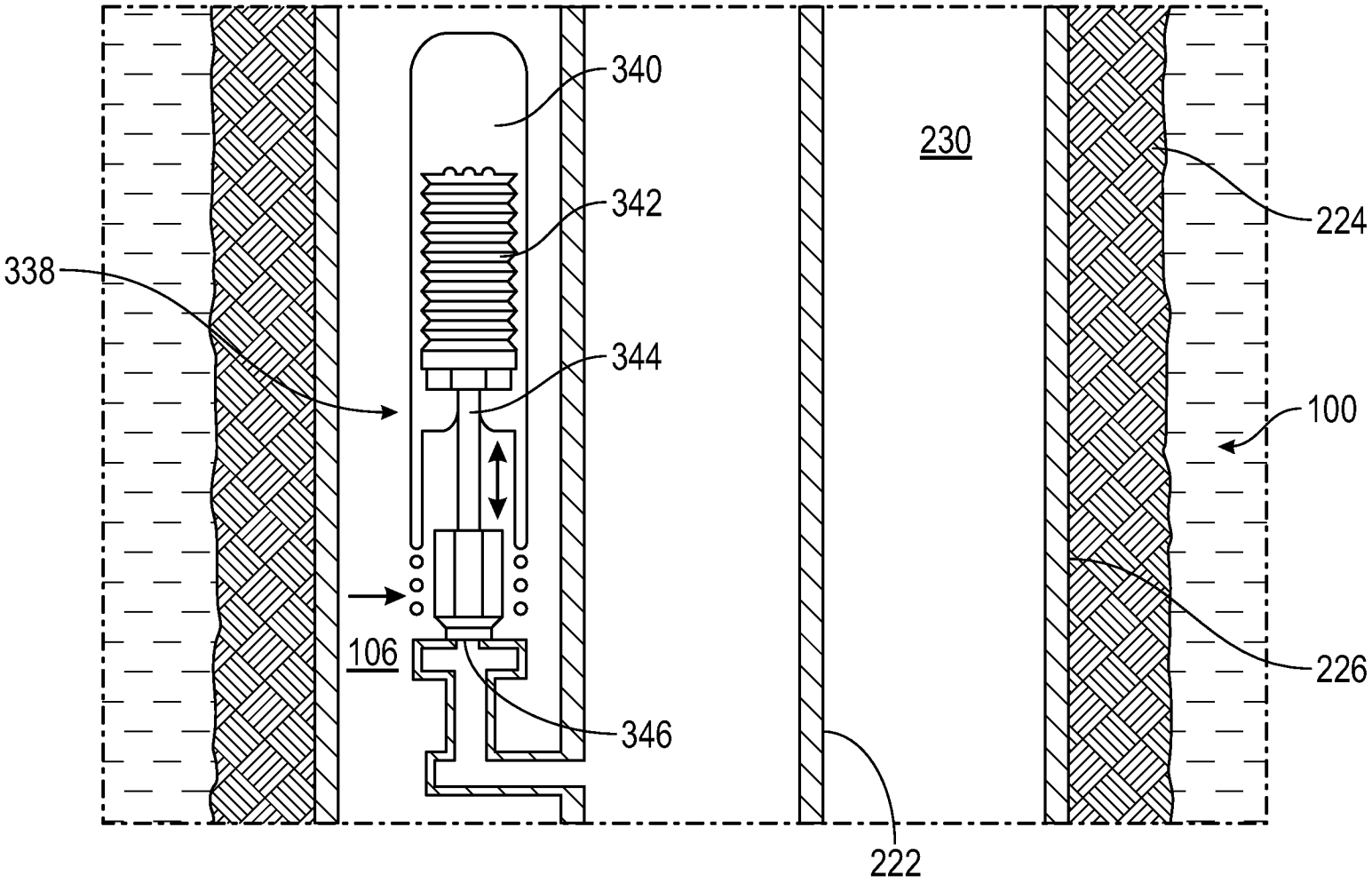
FIG. 5 shows an injection pressure operated gas lift valve in accordance with one or more embodiments.

FIGS. 4*a*, 4*b*, and 5 depict the major operating components of the gas lift system disclosed. In particular, FIGS. 4*a* and 4*b* depict an inflow control valve ("ICV") (220) in an open position and a closed position. More specifically, FIG. 4*a* depicts the ICV (220), in the open position, installed in a production tubing string (222) deployed in a wellbore (224), and FIG. 4*b* depicts the ICV (220), in the closed position, installed in the production tubing string (222) deployed in the wellbore (224). The wellbore (224) has casing (226) that supports the wellbore (224) and protects the wellbore (224) from an uncontrolled influx of subsurface fluids.

The casing (226) has a plurality of perforations (228) across a portion of the reservoir (100) containing gas (106) such that the gas (106) may exit the reservoir (100) and enter the annulus (230) located between the production tubing string (222) and the casing (226). An upper packer (232) and a lower packer (234) are installed above and below the ICV (220) in order to isolate the gas (106) to that portion of the annulus (230). The upper packer (232) and the lower packer (234) may be any kind of packer known in the art.

The ICV (220) is a technology commonly known in the art. The ICV (220) is installed across the portion of the reservoir (100) containing gas (106), as shown in FIGS. 4*a* and 4*b*, and the ICV (220) controls the flow of gas (106) into the system in which the ICV (220) is installed, such as the production tubing string (222). The ICV (220) may have pressure and temperature sensors. The ICV (220) may have a ball valve (235) or a flapper valve that prevents the gas (106) from flowing down the production tubing string (222). The ICV (220) may be controlled electrically through a cable that connects the ICV (220) to the surface and enables data transmission between the ICV (220) and the surface. The surface is any location outside of the wellbore (224) such as the Earth's surface, a data van, a control panel on the Earth's surface, etc.

In other embodiments, the ICV (220) may be controlled hydraulically though a hydraulic control line that connects the ICV (220) to the surface. The hydraulic control line is a conduit for hydraulic fluid that is able to control the ICV (220). When the ICV (220) is instructed to open, by a control panel or a computer processor either connected to the cable or the hydraulic control line, the ICV (220) shifts to reveal a plurality of channels (236), as depicted in FIG. 4*a*. The channels (236) allow the gas (106) to move from the annulus (230) into the production tubing string (222). When the ICV (220) is instructed to close, the ICV (220) shifts to close the channels (236), as depicted in FIG. 4*b*. This prevents the gas (106) from migrating from the annulus (230) into the production tubing string (222).

FIG. 5 shows an Injection Pressure Operated Gas Lift (IPO GL) valve (338) fixed to the production tubing string (222) deployed in wellbore (224). The IPO GL valve (338) may be located in the annulus (230) between the production tubing string (222) and the casing (226). The purpose of the IPO GL valve (338), when the IPO GL valve (338) is open, is to provide a conduit for subsurface fluids, such as gas (106), to enter the production tubing string (222) from the annulus (230). When the IPO GL valve (338) is closed, subsurface fluids are prevented from entering the production tubing string (222). The IPO GL valve (338) opens and closes in response to changes in injection pressure within the annulus (230).

The IPO GL valve (338) has a dome (340), bellows (342), a stem (344), and a port (346). The dome (340) is charged to a pre-determined pressure with a gas, such as nitrogen, prior to installation in the wellbore (224). The bellows (342)

are responsive to the injection pressure seen in the wellbore (224). When the injection pressure, seen by the bellows (342), overcomes the pre-determined pressure in the dome (340), the bellows (342) move in an upward direction relative to the production tubing string (222). When the injection pressure, seen by the bellows (342), is less than the pre-determined pressure in the dome (340), the bellows (342) move in a downward direction relative to the production tubing string (222). Movement of the bellows (342) cause the stem (344) to move in the same direction as the bellows (342). When the bellows (342) and stem (344) move in the upward direction, they cause the port (346) to open (i.e., the IPO GL valve (338) is open). When the port (346) is open, the annulus (230) and the production tubing string (222) are in communication, and the subsurface fluids located in the annulus (230) are able to enter the production tubing string (222).

Figure 6:
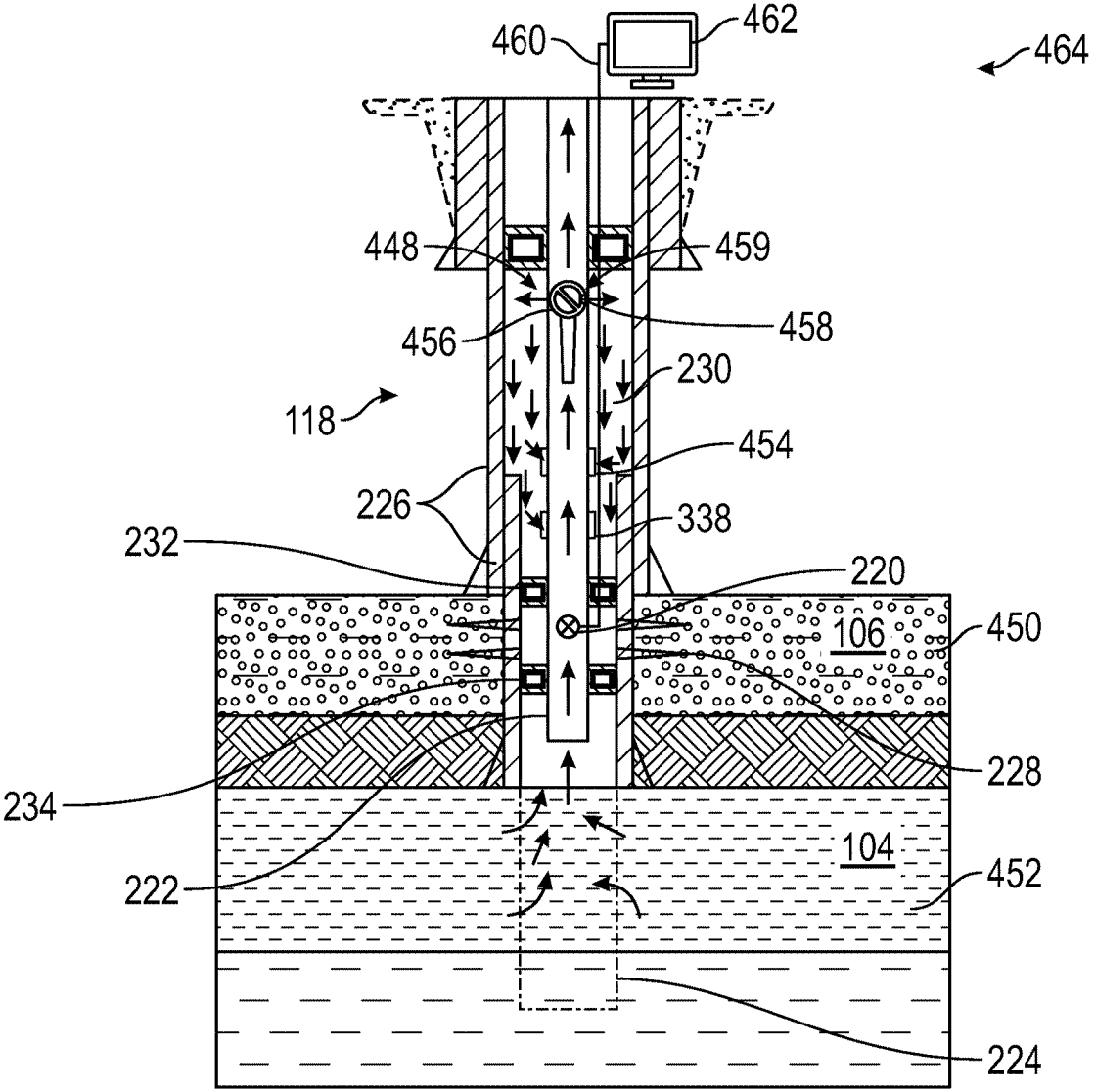
FIG. 6 shows a gas lift system in accordance with one or more embodiments.

FIG. 6 depicts, in one or more embodiments, a gas lift system (448) which uses in situ gas (106), from a gas reservoir (450), to artificially lift oil (104), from an oil reservoir (452). The components of the gas lift system (448) depicted in FIG. 6 that are identical/similar to the components depicted in FIGS. 4 and 5 are not re-described for purposes of readability and have the same functions described above. The gas lift system (448) is installed within a well (118) which is completed across the oil reservoir (452) and the gas reservoir (106).

The well (118) has casing (226) or liner that supports the wellbore (224) and isolates the subsurface fluids. The casing (226) or liner extends to a depth above the oil reservoir (452), and the wellbore (224) continues through the oil reservoir (452) with no casing (226) or liner. The casing (226) or liner is perforated with a plurality of perforations (228) across the gas reservoir (450) to allow gas (106) to enter the annulus (230) between the upper packer (232) and the lower packer (234).

In other embodiments, the casing (226) or liner may extend through the oil reservoir (452), and the casing (226) or liner may be perforated with a plurality of perforations (228) across the oil reservoir (452) to allow oil (104) to enter the casing (226) or liner. The gas lift system (448) includes a production tubing string (222) that extends to a depth above the oil reservoir (452). The production tubing string (222) is a conduit for production fluids. The production fluids may be any fluids produced at the surface (464) such as oil (104), gas (106), or water.

The production fluids have a weight which is the combined density of the mixture of fluids. In other embodiments, the production tubing string (222) may extend to a depth within the oil reservoir (452). For the embodiment depicted in FIG. 6 the production fluids is oil (104) and the oil (104) flows from the oil reservoir (452) into the wellbore (224), into the casing (226) or liner, and into the production tubing string (222). If the oil reservoir (452) has enough pressure, the oil (104) may flow up through the production tubing string (222) to be produced at the surface (464).

If the oil reservoir (452) does not have enough pressure to lift the weight of the oil (104) to the surface (464), then gas (106) is injected into the oil (104) to lower the weight of the oil (104) such that the combined weight of the oil (104) and gas (106) is lower than the pressure of the oil reservoir (452) and the production fluids and the injected gas (106) are able to flow through the production tubing string (222) using the pressure from the oil reservoir (452). The gas (106) is injected into the oil (104) using a combination of the ICV (220), the IPO GL valve (338), other gas lift (GL) valves (454), and a gas-separator compressor turbine device (456).

The ICV (220) opens to allow gas (106) to enter the production tubing string (222) from the portion of the annulus (230) between the upper packer (232) and the lower packer (234). The gas (106) flows up the production tubing string (222) to be separated from any other production fluids that may be in the production tubing string (222) and compressed by the gas-separator compressor turbine device (456). The gas-separator compressor turbine device (456) injects the gas (106) into the portion annulus (230) located above the upper packer (232). The gas-separator compressor turbine device (456) is a device well known in the art; an example is the SPARC proto-type by Haliburton.

When the injection pressure in the annulus (230) reaches a predetermined pressure, the IPO GL valve (338) opens, and the gas (106) enters the production tubing string (222) through the IPO GL valve (338). There may be other GL valves (454) installed on the production tubing string (222) such as pressure actuated valves like production pressure operated (PPO) valves, differential pressure operated (DPO) valves, throttling valves, or pilot valves all of which are well known in the art. The other GL valves (454) may also allow the injected gas (106) to enter the production tubing string (222) from the annulus (230).

The lighter weight of the gas (106), along with the injection pressure, helps to lower the weight of the production fluids and helps to lift the production fluids through the well (118) and to the surface (464). When the injected gas (106) reaches the height of the gas-separator compressor turbine device (456), the injected gas (106), along with any new gas (106) from the gas reservoir (450), is separated from the production fluids and the process is repeated. This process allows very little gas (106) to reach the surface (464) meaning that the gas (106) from the gas reservoir (450) is continually recycled to help lift the production fluids.

There is at least one sensor (458) installed on the outlet (459) of the gas-separator compressor turbine device (456) that measures the volume of the gas (106) being injected into the annulus (230). The sensor (458) may be upstream and/or downstream pressure and temperature sensors. Once the volume of gas (106) reaches a predetermined volume, the ICV (220) will close, and the production fluids may continue to flow due to the recycling of gas (106) through the gas-separator compressor turbine device (456).

When the volume of gas (106) being injected into the annulus (230) becomes lower than the pre-determined volume, the ICV (220) will open to allow more gas (106) to enter the production tubing string (222) from the gas reservoir (450). This process may be repeated as many times as required. In further embodiments, the amount of gas (106) needed to lift the production fluids may change over time and the predetermined volume of gas (106) injected into the annulus (230) may change as needed.

As depicted in FIG. 6, the ICV (220) is open and closed using at least one cable (460), electronically capable of transmitting data, connecting the ICV (220) to a control panel (462) at the surface (464). Instructions may come from the control panel (462) using an automated program or instructions may come from a person at the surface controlling the control panel (462). The ICV (220) may also be opened partially or completely for example, the ICV (220) may have ten "steps", with step 0 being a 0% open position (referred to as a "fully closed" position), step 1 being a 10% open position, step 2 being a 20% open position, and so forth, with step 10 being a 100% open position (referred to as a "fully opened" position).

It is obvious to a person of ordinary skill in the art that the ICV (220) may be controlled using any means available in the art and is not limited to using a cable (460) or a hydraulic control line. Furthermore, it is obvious that the well completion design is not limited to the design depicted in FIG. 6, and any system that uses a gas-separator compressor turbine device (456) to recycle in-situ gas (106) for use in a gas lift system (448) and an ICV (220) to control the flow of the gas (106) from the reservoir (100) may be used without departing from the scope of this disclosure.

Figure 7:
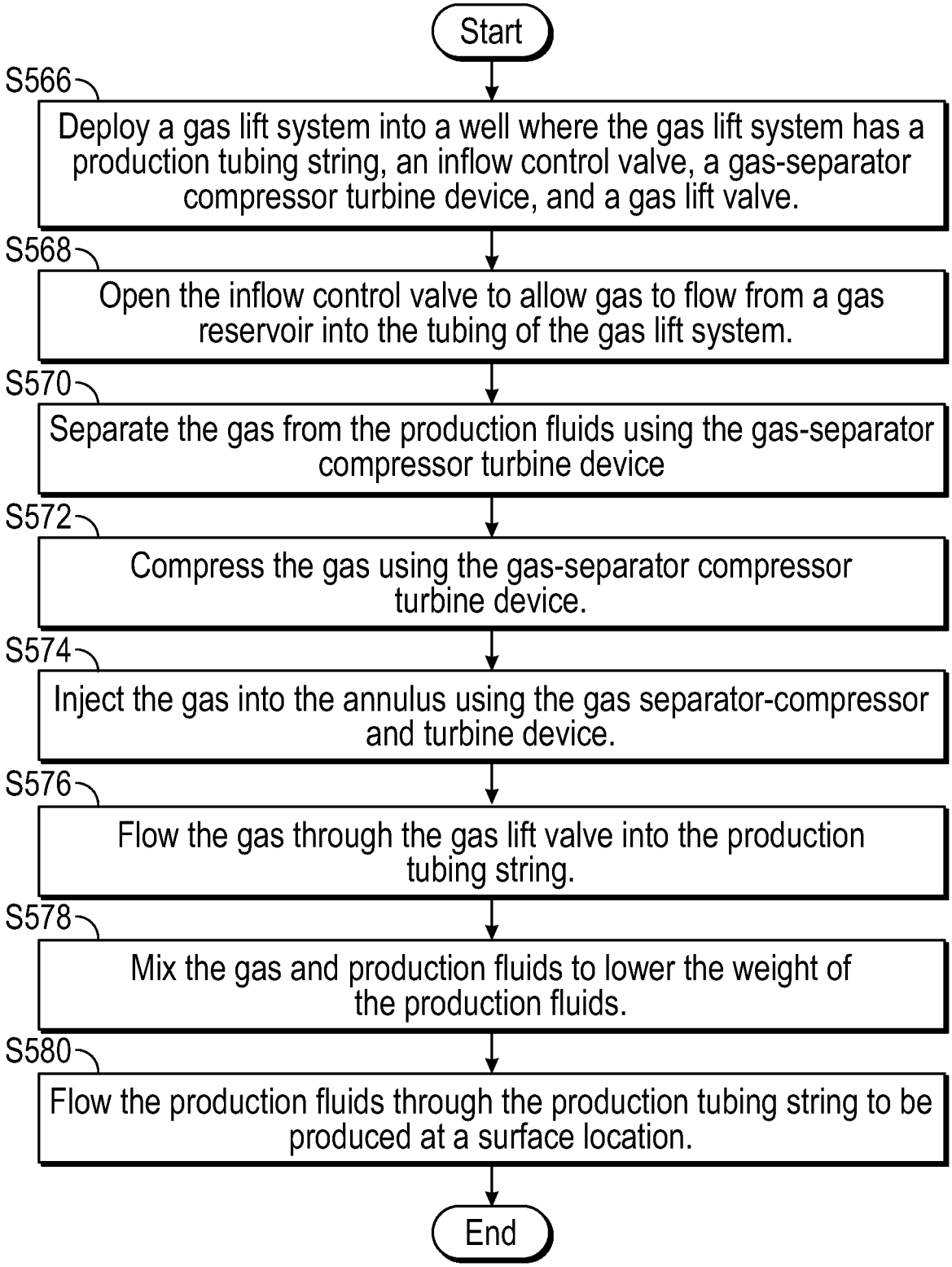
FIG. 7 shows a method in accordance with one or more embodiments.

FIG. 7 depicts a flowchart in accordance with one or more embodiments. More specifically, FIG. 7 illustrates a method for using a gas lift system (448) that uses and recycles in-situ gas (106) to lift production fluids to the surface (464). Further, one or more blocks in FIG. 7 may be performed by one or more components as described in FIGS. 4-6. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a gas lift system (448) having a production tubing string (222), an ICV (220), a gas-separator compressor turbine device (456), and a GL valve (454) is deployed into a well (118) (S566). The well (118) is completed across a gas reservoir (450) and an oil reservoir (452). The well (118) has casing (226) or liner supporting the wellbore (224) and isolating subsurface fluids. The casing (226) or liner may be perforated to allow a controlled influx of subsurface fluids to enter the production tubing string (222) through perforations (228).

The ICV (220) may be controlled using a cable (460) that is able to transfer data between the ICV (220) and a control panel (462) at the surface (464). The ICV (220) is opened, by sending an instruction through the cable (460), to allow gas (106) to flow from the gas reservoir (450) into the production tubing string (222) of the gas lift system (448) (S568). In other embodiments, the ICV (220) may be instructed to open by a hydraulic flow line connected to a control panel (462) at the surface (464).

The gas (106) travels up the production tubing string (222) and is separated from any production fluids by the gas-separator compressor turbine device (456) (S570). The gas (106) is compressed by the gas-separator compressor turbine device (456) (S572) and the gas (106) is injected into the annulus (230) between the casing (226) and the production tubing string (222) using the gas-separator compressor turbine device (456) (S574). The gas (106) flows from the annulus (230) into the production tubing string (222) using the GL valve (454) (S576). The GL valve (454) may be an IPO GL valve (338), as depicted in FIG. 5, or the GL valve (454) may be pressure actuated valves such as production pressure operated (PPO) valves, differential pressure operated (DPO) valves, throttling valves, or pilot valves. Further, there may be more than one GL valve (454) installed along the production tubing string (222).

The injected gas (106) mixes with the production fluids in the production tubing string (222) to lower the overall weight of the production fluids (S578). The lower weight of the production fluids along with the injection pressure causes the production fluids to flow through the production tubing string (222) to be produced at a surface (464) location (S580). This process may be repeated until a predetermined volume of gas (106) has entered the gas lift system (448), at this point the ICV (220) may close partially or all the way to control the volume of gas (106) in the gas lift system (448). If the volume of gas (106) in the gas lift system (448) ever falls below the predetermined volume, then the ICV (220) may be opened again to allow more gas (106) to enter the production tubing string (222). The gas (106) should be recycled through the gas-separator compressor turbine device (456), and very little gas (106) should be produced at the surface (464).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A gas lift system for a well, having an annulus, completed across a gas reservoir and an oil reservoir, the gas lift system comprising:

tubing configured to be a conduit for production fluids having a weight;

an inflow control valve, installed within the tubing, configured to control gas from the gas reservoir into the well by closing when a predetermined volume of gas is reached;

a gas-separator compressor turbine device installed within the tubing;

at least one sensor, configured to measure a volume of gas being injected into the annulus, fixed to an outlet of the gas-separator compressor turbine device;

a gas lift valve configured to allow flow of the gas from the annulus into the tubing; and an injection pressure operated gas lift valve configured to allow flow of the gas from the annulus into the tubing, wherein the gas and the production fluids, from the oil reservoir, mix to lower the weight of the production fluids and flow the production fluids through the tubing to be produced at a surface location.

2. The gas lift system of claim 1, further comprising:

a hydraulic control line connecting the inflow control valve to a control panel at the surface location.

3. The gas lift system of claim 2, wherein the hydraulic control line is a conduit for hydraulic fluid and is configured to hydraulically control the inflow control valve.

4. The gas lift system of claim 1, further comprising:

a cable connecting the inflow control valve to a computer processor at the surface location.

5. The gas lift system of claim 4, wherein the cable enables data transmission and is configured to electrically control the inflow control valve.

6. The gas lift system of claim 1, wherein the gas lift valve is a pressure actuated valve responsive to pressure in the tubing.

7. The gas lift system of claim 1, wherein the gas-separator compressor turbine device is configured to separate the gas from the production fluids, compress the gas, and inject the gas into the annulus.

8. The gas lift system of claim 1, further comprising:

an upper packer and a lower packer fixed within the annulus and configured to isolate the supply of gas to a portion of the annulus.

9. A method for producing a well having an annulus completed across a gas reservoir and an oil reservoir, the method comprising:

deploying a gas lift system into the well, the gas lift system comprising:

tubing configured to be a conduit for production fluids having a weight;

an inflow control valve;

a gas-separator compressor turbine device;

at least one sensor fixed to an outlet of the gas-separator compressor turbine device;

a gas lift valve installed within the tubing;

wherein the inflow control valve, the gas-separator compressor turbine device, and the gas lift valve, are configured to be installed within the tubing;

opening the inflow control valve to allow gas to flow from the gas reservoir into the tubing;

separating the gas from the production fluids using the gas-separator compressor turbine device;

compressing the gas using the gas-separator compressor turbine device;

injecting the gas into the annulus using the gas-separator compressor turbine device;

flowing the gas through the gas lift valve into the tubing;

measuring a volume of gas being injected into the annulus using the at least one sensor;

closing the inflow control valve when a predetermined volume of gas is reached;

mixing the gas and the production fluids to lower the weight of the production fluids; and flowing the production fluids through the tubing to be produced at a surface location.

10. The method of claim 9, further comprising:

wherein the gas lift valve is an injection pressure operated gas lift valve.

11. The method of claim 9, further comprising:

connecting the inflow control valve to a control panel at the surface location using a hydraulic control line.

12. The method of claim 11, wherein the hydraulic control line is a conduit for hydraulic fluid and is configured to hydraulically control the inflow control valve.

13. The method of claim 9, further comprising:

connecting the inflow control valve to a control panel at the surface location using a cable.

14. The method of claim 13, wherein the cable enables data transmission and is configured to electrically control the inflow control valve.

15. The method of claim 14, further comprising:

isolating the gas to a portion of the annulus using an upper packer and a lower packer fixed within the annulus.

* * * * *